United States Patent [19]

Rivette et al.

[11] 4,358,104

[45] Nov. 9, 1982

[54] TETHERED TOY VEHICLE CONTROL APPARATUS

[75] Inventors: Denni F. Rivette, Chicago; Harry Disko, South Barrington, both of Ill.

[73] Assignee: Marvin Glass & Associates, Chicago, Ill.

[21] Appl. No.: 200,159

[22] Filed: Oct. 24, 1980

[51] Int. Cl.[3] ..... A63H 17/38; A63H 30/00

[52] U.S. Cl. ..... 272/31 R; 46/210

[58] Field of Search ..... 272/31 R, 31 A, 31 B, 272/31 P; 46/202, 77, 210, 112, 253, 262; 273/1 GA

[56] References Cited

U.S. PATENT DOCUMENTS

| | | | |
|---|---|---|---|
| 2,639,545 | 5/1953 | Pastorius | 46/210 X |
| 3,014,718 | 12/1961 | Telzrow | 272/31 A |
| 3,246,423 | 4/1966 | Glass et al. | 272/31 R X |
| 3,615,092 | 10/1971 | Stubbmann | 272/31 R X |
| 3,706,153 | 12/1972 | Folson et al. | 46/202 |
| 3,731,424 | 5/1973 | Meyer | 46/253 X |
| 3,822,880 | 7/1974 | Terzian et al. | 272/31 R |

FOREIGN PATENT DOCUMENTS

| | | | |
|---|---|---|---|
| 1011796 | 7/1957 | Fed. Rep. of Germany | 272/31 R |
| 639458 | 6/1950 | United Kingdom | 272/31 R |

*Primary Examiner*—Richard C. Pinkham
*Assistant Examiner*—Arnold W. Kramer
*Attorney, Agent, or Firm*—Mason, Kolehmainen, Rathburn & Wyss

[57] ABSTRACT

A tethered vehicle control apparatus is described which includes a control station and a remote station. A strand connecting the control station to the remote station exits from the remote station through an aperture for connection to a self-propelled toy vehicle. The control station and remote station are connected by a housing through which the strand extends and over which the vehicle passes as it circles the remote station. The control station includes a steering wheel upon which the strand is wound to adjust the length of the portion of the strand that connects the remote station to the toy vehicle in order to change the direction of movement of the toy vehicle as it rotates around the remote station.

1 Claim, 4 Drawing Figures

10
14
16
18
20
22
24
40
42
60
62
78
80
12

14
16
18
20
26
28
30
32
34
52
55
56
57
58
60
62
64
3

12
20
68
70
72
74
76
78
79

16
18
20
22
24
26
30
32
34
38
40
42
44
46
48
50
52
54
56
57
58
60
62
63
64
66

TETHERED TOY VEHICLE CONTROL APPARATUS

BACKGROUND OF THE INVENTION

1. Field of the Invention

This invention relates generally to amusement devices and particularly to control apparatus for self-propelled land vehicles.

2. Brief Description of the Prior Art

It is known to control the path of travel of a toy vehicle by attaching one end of a string to the vehicle and then permitting the vehicle to drive in a circle around the point of attachment of the other end of the string. U.S. Pat. Nos. 3,799,544 and 4,222,558 are examples of the prior art relating to tethered vehicles. However, the prior art lacks a mechanism in the form of a steering wheel for controlling a toy vehicle from a location outside its circular path of travel.

SUMMARY OF THE INVENTION

The present invention involves a vehicle control apparatus for self-propelled tethered toy vehicles including a control station and a remote station. A connecting housing between the remote station and the control station is adapted to be driven over by the toy vehicle. A flexible strand extends from the control station to the remote station through the connecting housing and extends out of the remote station for connection to the toy vehicle. Means are provided on the control station for adjusting the length of extension of the strand from the remote station.

BRIEF DESCRIPTION OF THE DRAWING

The objects and advantages of the present invention will become more apparent by reference to the following description taken in conjunction with the accompanying drawing, wherein.

DESCRIPTION OF THE PREFERRED EMBODIMENT

Figure 1:
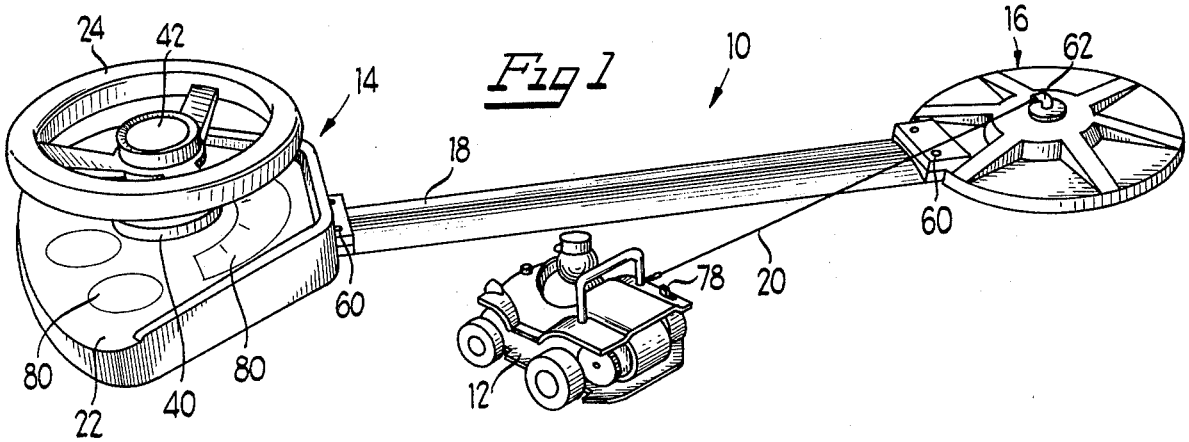
FIG. 1 is a perspective view of one embodiment of the present invention.

Referring to the drawing wherein like reference characters are used for like parts throughout, there is illustrated in FIG. 1 a remote control apparatus 10 linked to a toy vehicle 12. The remote control apparatus 10 includes a control station 14, a remote station 16 and a connecting housing 18. A flexible strand 20 such as a string extends from control station 14 through connecting housing 18 and into remote station 16. The strand exits from remote station 16 and extends outwardly of remote control apparatus 10 to connect to the toy vehicle 12. The toy vehicle 12 is preferably a self-propelled wheeled vehicle.

Figure 2:
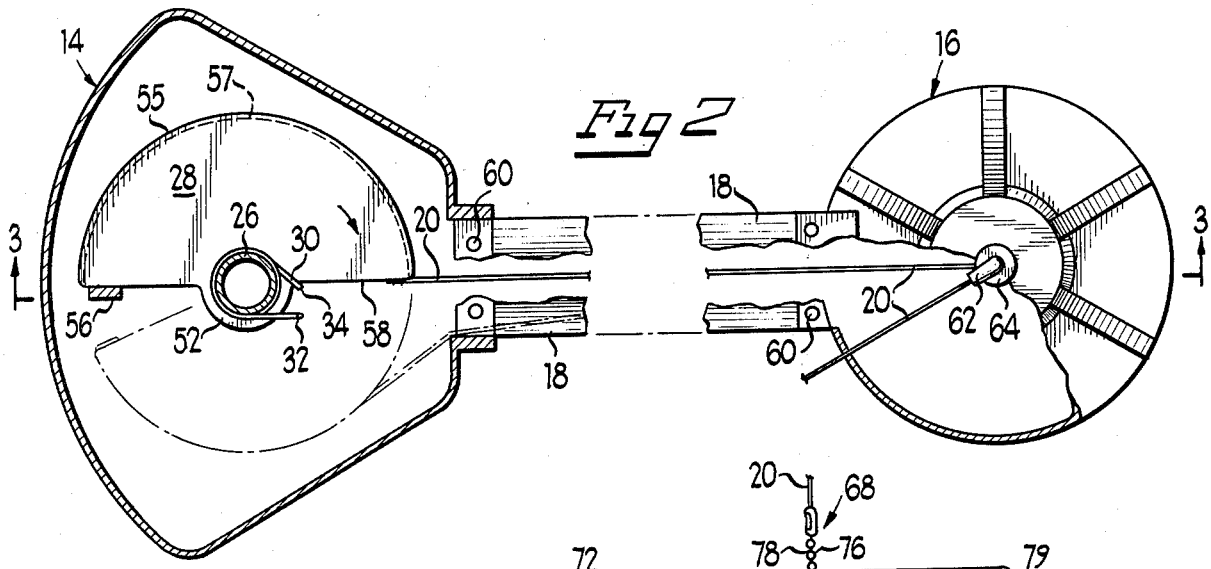
FIG. 2 is an enlarged, partial, cut-away, top elevational view of the embodiment of FIG. 1.
Figure 3:
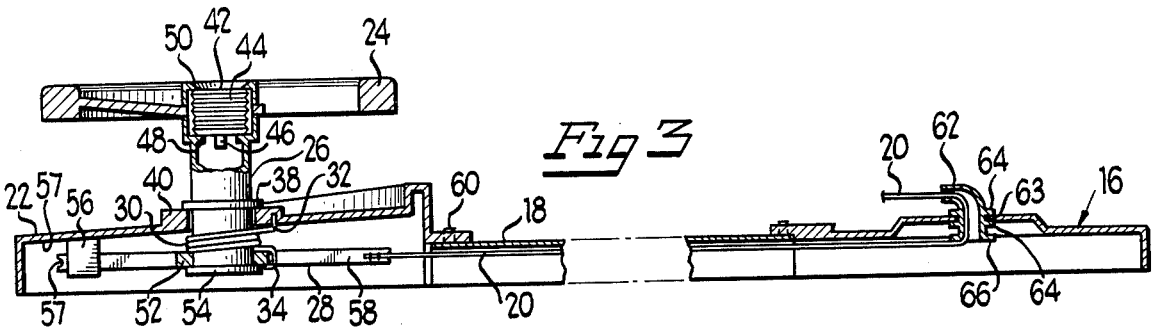
FIG. 3 is a partial, cross-sectional view taken generally along line 3—3 of FIG. 2.

The control station 14 includes a control panel 22 and a steering wheel 24 extending outwardly of control panel 22. As shown in FIGS. 2 and 3, the steering wheel 24 includes a central shaft 26 coaxially attached to a drum 28 located within the interior of control panel 22. Rotation of the external steering wheel 24 causes an identical rotation of the internal drum 28. A coil spring 30 is mounted on shaft 26 with one end 32 fixed to control panel 22 and the other end 34 connected to drum 28.

The shaft 26 is rotatably mounted within control panel 22 by means of a ring 38 which slides on an outwardly extending land 40 on control panel 22 as shown in FIG. 3. The upper portion of the interior of shaft 26 is adapted to receive a horn 42 conveniently in the form of a bellows 44 connected to an air sounder 46. The bellows 44 is mounted near the top of the shaft 26 to be accessible from above and is retained for sliding movement within the shaft 26 by a pair of opposed circular lands 48 and 50. When the bellows 44 is depressed from above by the user's finger, air is forced through the sounder 46. For amplification, the sound created passes through the interior of the shaft 26 and into the interior of the control station 14.

The drum 28 is generally semi-circular in shape with a ring portion 52 shown in FIG. 2, encircling the shaft 26. The drum fixed to shaft 26 by an outwardly extending circular land 54 at the bottom of shaft 26. The degree of rotation of the drum 28 is controlled by a stop 56, extending downwardly from the upper interior surface 57 of the control panel 22 located approximately 180° from the leading edge 58 of the drum 28 when the drum is in its original position shown in FIGS. 2 and 3. The peripheral edge 55 of drum 28 includes a groove 57 designed to receive strand 20.

The strand 20 attached on one end to the leading edge 58 of drum 28 extends from the control station 14 through the connecting house 18 to the remote station 16. The connecting house 18 has an inverted generally V-shaped cross-section so that the vehicle 12 can easily drive over the connecting housing 18. The connecting housing 18 may be attached to the control station 14 and the remote station 16 by threaded attachments 60 such as screws or the like.

The strand 20 passes through remote station 16 by way of a central, rotatable L-shaped guide tube 62. The guide tube 62 is retained within an aperture 63 in remote station 16 by a pair of spaced flexible peripheral flanges 64 on tube 62 as shown in FIG. 3. The lower end 66 of the guide tube 62 is flared to enable the strand 20 to slide freely through guide tube 62. The guide tube 62 serves to redirect the strand 20 to the vehicle 12 and to insure that the strand 20 slides freely through the station 16.

Figure 4:
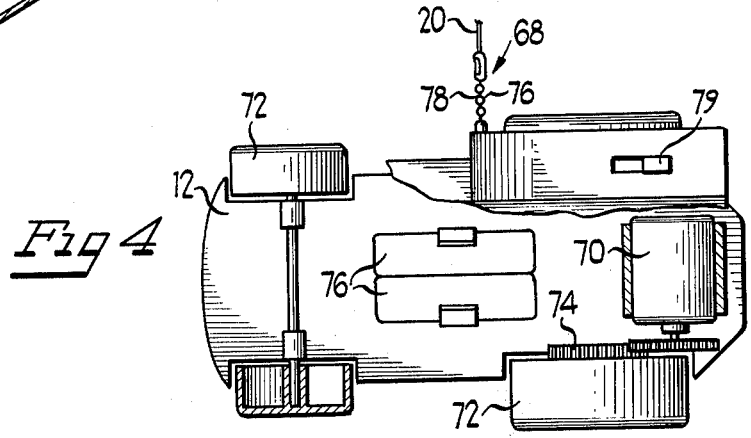
FIG. 4 is an enlarged cut-away top plan view of the toy vehicle shown in FIG. 1.

The strand 20 is attached to the toy vehicle 12, preferably by means of a swivel connection 68 shown in FIG. 4. The swivel connection 68 is conveniently a short piece of conventional chain made of hollow metal balls 76 connected by wire 78 that permits the strand 20 to rotate with respect to the vehicle 12. The toy vehicle 12 is otherwise conventional and includes a motor 70 which drives one or more wheels 72 through a wheel gear 74. The vehicle 12 may also include its own power source, such as batteries 76, controlled by an on-off switch 79.

As shown in FIG. 1, the remote control apparatus 10 is conveniently made of molded plastic shaped to resemble a racing car track by making the control station 14 simulate the dashboard of an automobile and by making the remote station 16 similar in appearance to a pylon or other obstacle around which racing drivers are required to maneuver. For added realism the control panel 22 may include simulated gauges 80.

The apparatus 10 operates as follows. The toy vehicle 12 is connected to strand 20 and operated to propel itself. The vehicle 12 is caused to circle around remote station 16 in an arc controlled by the length of strand 20. Since the connecting housing 18 is of minimal height the path of travel of the vehicle 12 will not be significantly affected by the presence of the housing 18 in the vehicle's path of travel. To change the direction of the toy vehicle 12, the user turns steering wheel 24 in a clockwise direction, as indicated by the arrow in FIG. 2. This action causes drum 28 to rotate in an identical direction and degree to reel in the strand 20 so that it is wrapped onto the groove 57 as indicated in dashed lines in FIG. 2. As a result, the vehicle 12 is pulled inwardly toward remote station 16 by a turn to its right as would be expected by the right turn of a real automobile steering wheel. The extent of the turn experienced by the toy vehicle 12 is controlled by the degree of rotation applied to the steering wheel 24. Thus, the user can selectively adjust the length of the strand and particularly the length of the strand from the remote station to the toy vehicle 12 to selectively control the direction of the toy vehicle's path of travel around the remote station 16. After the toy vehicle has been caused to turn as just described, the user can release the steering wheel 24, thereby returning it to its original position due to the action of spring 30. As a result the strand 20 is unreeled from drum 28 returning the vehicle by a left turn to its original arc of travel. The maximum rotation of steering wheel 24 and drum 28 is controlled by stop 56 to avoid unrealistic maneuvering of the vehicle 12. The vehicle can continue in a generally circular or elliptical path around the remote station 16 as desired.

The foregoing detailed description has been given for clearness of understanding only and no unnecessary limitations should be understood therefrom as many modifications will be obvious to those skilled in the art.

What is claimed and is desired to be secured by Letters Patent of the United States is:

1. A control apparatus for self-propelled toy vehicles comprising:

a control station;

a remote station;

a connecting housing between said remote station and said control station;

a flexible strand extending from said control station to said remote station through said connecting housing and extending out of said remote station for connection to said toy vehicle; and said control station including means for selectively adjusting the length of extension of said strand from said remote station, said adjusting means including a rotatable, generally semicircular drum and a steering wheel connected to said drum, said drum connected to one end of said strand, rotation of said steering wheel in one direction causing said strand to be wound onto said drum, pulling said vehicle inwardly toward said remote station, said control station further including stop means for limiting the degree of rotation of the steering wheel in either direction of rotation with said strand completely paid out when said steering wheel is at its limit in the other direction.

* * * * *